United States Patent [19]

White et al.

[11] Patent Number: 4,803,817

[45] Date of Patent: Feb. 14, 1989

[54] GLAZING ASSEMBLY AND METHOD FOR GLAZING A BUILDING

[75] Inventors: Harold J. White; Richard M. House, both of Thornhill; Worsel Vaughn, Mississauga, all of Canada

[73] Assignee: Thornhill Glass & Mirror Inc., Concord, Canada

[21] Appl. No.: 43,254

[22] Filed: Apr. 24, 1987

[51] Int. Cl.[4] ..... E04B 2/88

[52] U.S. Cl. ..... 52/235; 52/511; 52/747

[58] Field of Search ..... 52/235, 511, 741, 747

[56] References Cited

U.S. PATENT DOCUMENTS

| | | | |
|---|---|---|---|
| 3,715,848 | 2/1973 | Jordan | 52/235 |
| 3,940,897 | 8/1976 | Stoakes . | |
| 4,092,812 | 7/1978 | Dashner et al. . | |
| 4,471,584 | 9/1984 | Dietrich . | |
| 4,483,122 | 11/1984 | Crandell . | |
| 4,522,003 | 6/1985 | Akihama et al. . | |
| 4,581,868 | 4/1986 | McCann . | |
| 4,625,481 | 12/1986 | Crandell | 52/235 |
| 4,633,631 | 1/1987 | Crandell | 52/235 |
| 4,650,702 | 3/1987 | Whitmyer | 52/235 |
| 4,665,662 | 5/1987 | Swanborn | 52/235 |
| 4,683,693 | 8/1987 | Rockar | 52/235 |
| 4,685,263 | 8/1987 | Ting | 52/235 |

FOREIGN PATENT DOCUMENTS

| | | | |
|---|---|---|---|
| 46561 | 4/1963 | Poland . | |
| 1014857 | 5/1965 | United Kingdom . | |
| 2142357 | 1/1985 | United Kingdom | 52/235 |

*Primary Examiner*—Henry E. Raduazo
*Attorney, Agent, or Firm*—Ridout & Maybee

[57] ABSTRACT

A glazing assembly for the exterior of a building comprises glazing structures each having rigid channel forming members bonded about its perimeter. The channels so formed are oriented open to the periphery of the structure. Pressure plates are inserted in the channels of the glazing structures, and are fastened to structural members of the building by mechanical means such as screws. Each pressure plate coacts with a channel member and preferably with channel members of adjacent glazing structures to mechanically secure the structures in place on the building without the appearance of external frame members. The resulting assembly provides continuous glazing for the exterior walls of the building.

9 Claims, 4 Drawing Sheets

GLAZING ASSEMBLY AND METHOD FOR GLAZING A BUILDING

The present invention relates to a structure and method for glazing the exterior of a building.

Current building designs often incorporate the use of large sheets of glass to provide the building with a substantially complete glass exterior. However, prior known glazing methods have generally required the use of exterior structural members about each sheet of glass so that the uniformity of the resulting glass exterior is disrupted by such members. The present invention provides a structure and glazing method that enables the construction of a building having a substantially uniformly glazed exterior without the appearance of structural members about the exterior periphery of the individual sheets of glazing material.

Accordingly, the present invention provides a glazing assembly for a building which comprises glazing structures each having rigid channel forming members bonded about its perimeter. The channels so formed are oriented open to the periphery of the structure. Pressure plates are inserted in the channels of the glazing structures, and are fastenable by mechanical means such as screws or bolts to structural members of the building. Each pressure plate coacts with a channel member and with a structural member of the building to mechanically secure the glazing structure in place. A pressure plate preferably coacts with the channel members of adjacent glazing structures.

Additionally, the present invention provides a method for glazing a building, comprising bonding a rigid channel forming members about the perimeter of a glazing structure. The channels so formed are oriented open to the periphery of the structure. The structures are then attached to the exterior of the building by means of pressure plates inserted in the channels and mechanically fastened to structural members of the building.

BRIEF DESCRIPTION OF THE DRAWINGS

Referring to FIG. 1, the invention provides a glazing structure 10 having a single glazing sheet 11 for attachment to the exterior of a building. The structure 10 avoids the use of external support members for individual glazing sheets 11, thereby providing a substantially uniformly glazed exterior surface for the building. Each sheet 11 is provided with rigid channel forming members 13 bonded about the inside perimeter of the sheet 11 with a bonding agent 14. The channel members 13 are oriented to be open to the edges 15 of the sheet 11.

Figure 1:
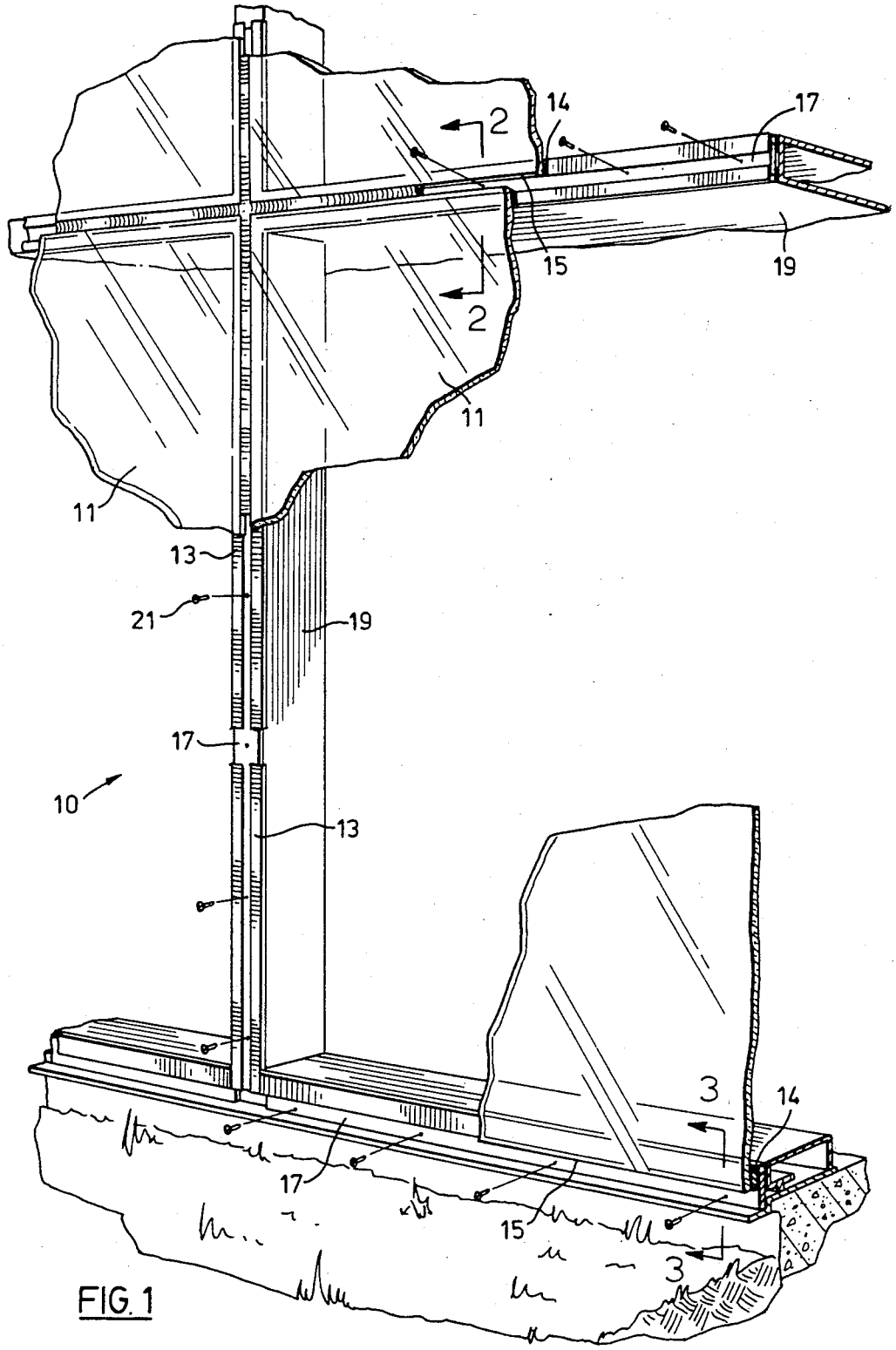
FIG. 1 is a perspective view partially broken away of a glazing assembly of the invention as installed.

Preferably, the manufacture of the glazing structures 10 is accomplished at a suitable manufacturing facility, and then transported to the job site ready for installation. The channel members 13 may be bonded to the glazing sheets 11 by any of a number of bonding agents 14 well known to those skilled in this art. A bonding agent 14 must be compatible with the glazing material and any coating which may be applied to it. A preferred bonding agent 14 for many applications is available under the trade mark DOW CORNING 795 and is a silicone adhesive.

The glazing structures 10 of the invention are affixed to the building by means of pressure plates 17 each having a thickness allowing it to be inserted in the channel 23 defined by the channel member 13 bonded to the sheet 11. For many applications the thickness of the plate 17 may be about 0.5 inches. The pressure plates 17 affix the sheets 11 onto the building by being mechanically attachable to building structural members 19.

Figure 2:
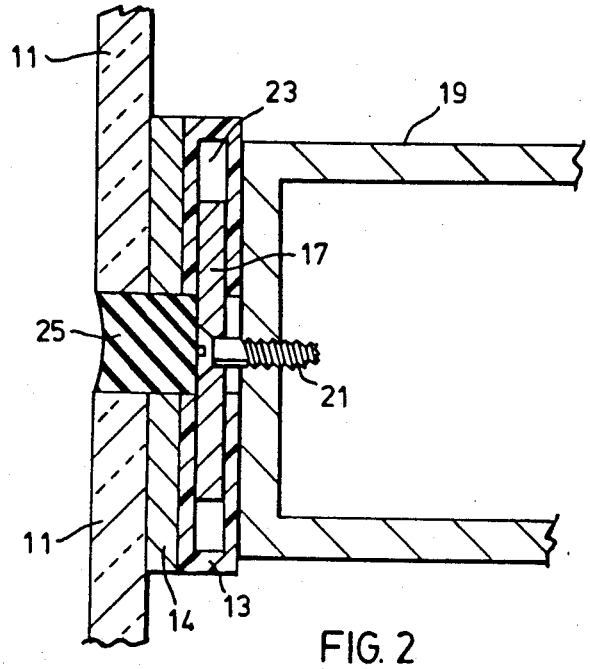
FIG. 2 is a vertical cross sectional view through line 2—2 in FIG. 1.

As shown in FIG. 2, a pressure plate 17 may coact with channel members 13 of two adjacent sheets 11 to attach them to a structural member 19 of a building. Mechanical attachment is illustrated in FIG. 2 by a screw 21, but any suitable mechanical attachment means may be used. While the pressure plate 17 shown in FIG. 2 is wide enough to coact with channel members 13 of adjacent sheets 11, it should not be so wide as to substantially occupy both opposing channels 23. By providing a width enabling the maximum occupancy of about two thirds of the depth of the channel 23, the pressure plate 17 allows a margin for positioning of the sheet 11 relative to the other sheets 11 already installed. Also, installation of the sheets 11 is easier if there is some margin for adjustment of the channel members 13 relative to the pressure plates 17. Until the adjacent sheets 11 (FIG. 2) are positioned as desired, the pressure plate 17 is not tightened down against the structural member 19, but the fasteners 21 are provided to loosely locate the pressure plate 17 relative to the adjacent channel members 13. In FIG. 2 the pressure plate 17 can be seen to coact with the channel members 13 of adjacent sheets 11 and the structural member 19 of the building to effect a positive mechanical attachment of the sheets 11 to the building.

A pressure plate 17 does not need to occupy the entire length of each channel member 13. It has been found to be preferable to use several relatively short plates 17 along each length of channel member 13 in order to give the installer more flexibility for positioning the glazing sheet 11. The use of several short plates 17 along each edge of the sheet 11 instead of one long plate 17 makes replacement of a broken sheet 11 much easier.

After the glazing sheets 11 are secured in place on the building by the pressure plates 17, the gaps between adjacent structures 10 are preferably filled with a suitable caulking material 25 such as a silicone sealant.

Figure 3:
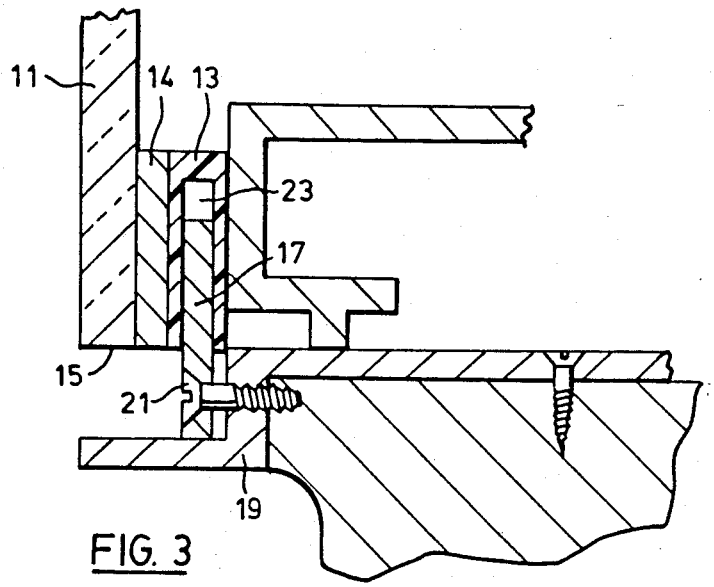
FIG. 3 is a vertical cross sectional view through line 3—3 in FIG. 1.

FIG. 3 illustrates the assembly of the invention at an edge 15 of a glazing sheet 11 which is not adjacent another sheet 11. The principle of assembly in this case is the same as that discussed above, but the pressure plate 17 may be somewhat narrower and the fasteners 21 may be provided toward one edge of the plate 17 in contrast to the preferred arrangement shown in FIG. 2. As with the pressure plate 17 used between adjacent glazing sheets 11, the plate 17 shown in FIG. 3 may not penetrate the full depth of the channel 23, thereby allowing the sheet 11 to be easily positioned.

Figure 4:
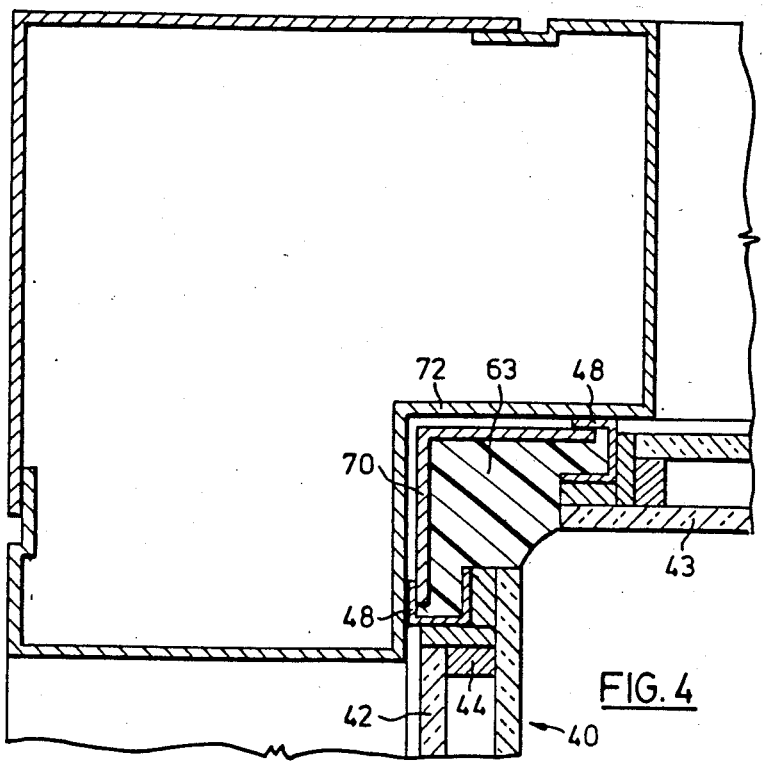
FIG. 4 is a horizontal cross sectional view showing the attachment of sealed double glazed units at an inner corner of a building.
Figure 5:
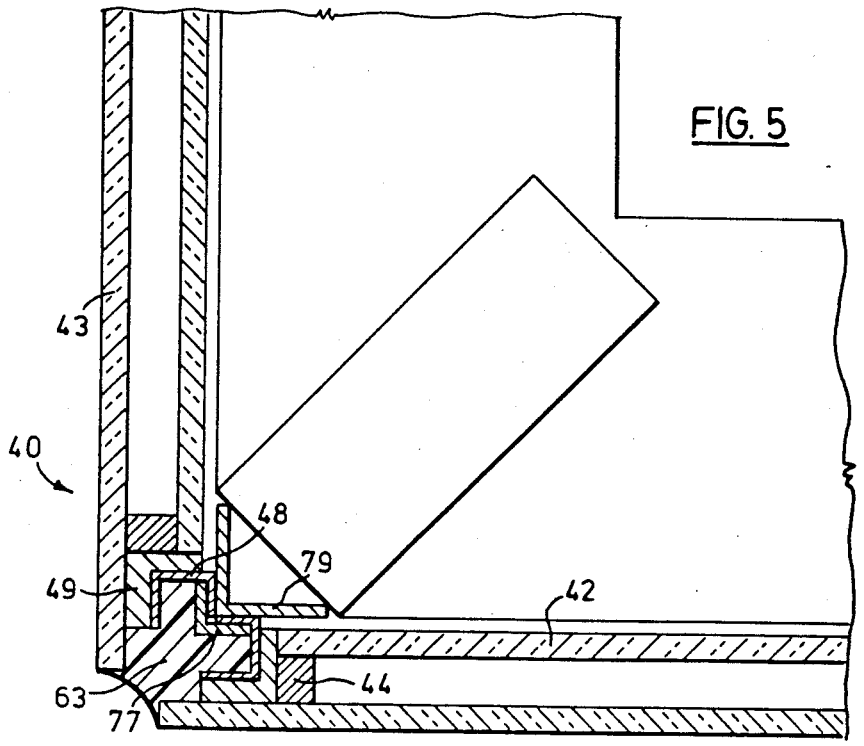
FIG. 5 is a horizontal cross sectional view showing the attachment of sealed units at an outer corner of a building.
Figure 6:
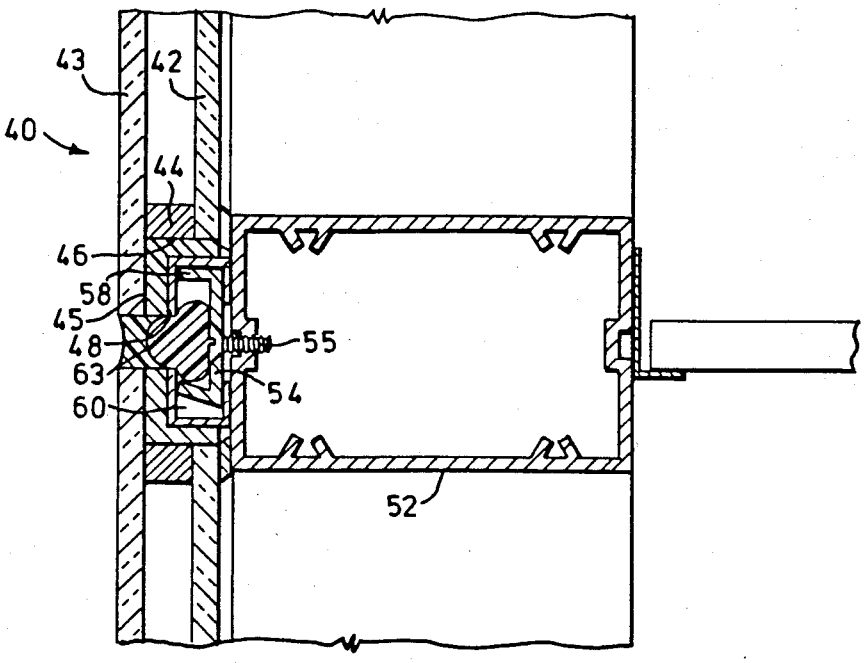
FIG. 6 is a vertical cross sectional view showing the attachment of sealed double glazed units.

The invention as applied to a sealed double glazed structure 40 is shown in FIGS. 4–6. The basic arrangement of elements is shown in FIG. 6 where the double glazed structure 40 has an inner sheet of glass 42 and an outer sheet of glass 43 spaced from one another by a frame 44. The outer sheet 43 extends beyond the periphery of the frame 44 and the inner sheet 42 to provide a peripheral flange 45 which in conjunction with the peripheral edge surface 46 provide an area for attachment of channel members 48 to the structure 40 by means of an appropriate adhesive 49.

The double glazed structures 40 are attached to structural members 52 of a building by means of pressure plates 54 which fit within the channel members 48. As described above, the pressure plates 54 may be attached to the structural members 52 by screws 55 or other suitable mechanical means. As illustrated in FIG. 6, the pressure plates 54 associated with the double glazed structures 40 may be provided with longitudinal flanges 58 each extending the width of the channel 60 formed by the channel member 48. The flanges 58 provide additional stability to the assembly, especially along the weight bearing edges.

Upon installation of the double glazed structures 40, the gap between adjacent structures 40 is filled with a sealant caulking material 63.

FIGS. 4 and 5 illustrate the preferred means of attachment of glazing structures at inside and outside corners of a building. These figures show double glazed structures 40, but the principles of attachment are equally applicable for single glazing sheets.

In the assembly shown in FIG. 4, an angled pressure plate 70 is used to engage channel members 48 of double glazed structures 40 meeting at an inside corner. The angled pressure plate 70 is attached to the building structural member 72 by mechanical means (not shown) as described above. For attachment of structures 40 at an outer corner the arrangement shown in FIG. 5 provides for an angled pressure plate 77 to engage channel members 48 so that mechanical attachment means will usually provide direct attachment of the channel member 48 as well as the pressure plate 77 to a structural member 79 of the building.

In both arrangements shown in FIGS. 4 and 5, a sealant caulking 63 is used to fill the space between adjacent structures 40.

The skilled person will appreciate from the foregoing that the inherent adjustability which is afforded to glazing materials by virtue of the invention provides significant advantages over known methods of exterior glazing of this general type. The finished assembly provides a wall of glass or other glazing material which is unbroken by external structural components. The assembly of the invention provides a mechanical securing of the glazing onto the building and ensures a rapid and accurate installation as well as ease of repair.

We claim:

1. A glazing assembly for a building, comprising:

a glazing structure having rigid channel forming members bonded about the periphery of a sheet of glazing material, the channel forming members having channels which open to the periphery of the structure; and pressure plates insertable into the channels, each pressure plate being engageable with a channel forming member of an adjacent glazing structure, the plates being mechanically fastenable directly to structural members of the building, thereby enabling each glazing structure to be positioned on and affixed to the building, said pressure plates each being of a width enabling the maximum simultaneous occupancy of about two thirds of the depth of each channel which allows each glazing structure to be adjustably positioned on the building.

2. A glazing assembly as claimed in claim 1, wherein the pressure plates are mechanically fastened to the structural members of the building by screws.

3. A glazing assembly as claimed in claim 1, wherein the channel forming members are bonded to the sheet of glazing material by means of silicone adhesive.

4. A glazing assembly as claimed in claim 1, wherein the glazing structure comprises a sheet of glass having channel forming members bonded to one side about the periphery thereof.

5. A glazing assembly as claimed in claim 1, wherein the glazing structure has an inner sheet of glass spaced from an outer sheet of glass by a frame.

6. A glazing assembly as claimed in claim 5, wherein the outer sheet of glass extends beyond the frame and inner sheet of glass to define a peripheral flange about the structure, the flange providing a surface for attachment of channel forming members.

7. A glazing assembly for a building, comprising:

a glazing structure having an inner sheet of glass spaced from an outer sheet of glass by a frame, and having rigid channel forming members bonded about the periphery of the structure, the channel forming members having channels which open to the periphery of the structure, the outer sheet of glass extending beyond the frame and inner sheet of glass to define a peripheral flange about the structure, the flange providing a surface for attachment of channel forming members; and pressure plates insertable in the channels and engageable with the channel forming members of the glazing structure, the plates being mechanically fastenable to structural members of the building, thereby enabling the glazing structure to be positioned on and affixed to the building.

8. A method for glazing a building, comprising:

providing a plurality of adjacent glazing structures, each glazing structure having rigid channel forming members bonded about the periphery of a sheet of glazing material, the channel forming members having channels which open to the periphery of each structure;

inserting pressure plates into the channels, each plate engaging a channel forming member of an adjacent glazing structure, said pressure plates each being of a width enabling the maximum simultaneous occupancy of about two thirds of the depth of each channel which allows each glazing structure to be adjustably positioned on the building; and attaching the pressure plates and glazing structures to the building by mechanical fastening means which fasten the pressure plates so engaging the channel forming members directly to structural members of the building.

9. A method for glazing a building as claimed in claim 8, which further comprises providing a gap between the adjacent glazing structures installed on the building and filling the gaps with a sealant caulking.

* * * * *